US007284961B2

(12) United States Patent
Jacobsen

(10) Patent No.: US 7,284,961 B2
(45) Date of Patent: Oct. 23, 2007

(54) PUMPING SYSTEM, REPLACEMENT KIT INCLUDING PISTON AND/OR CYLINDER, AND METHOD FOR PUMPING SYSTEM MAINTENANCE

(75) Inventor: Jerry Jacobsen, Edmonton (CA)

(73) Assignee: BS&B Safety Systems, Ltd., Limerick (IE)

( * ) Notice: Subject to any disclaimer, the term of this patent is extended or adjusted under 35 U.S.C. 154(b) by 68 days.

(21) Appl. No.: 10/162,747

(22) Filed: Jun. 6, 2002

(65) Prior Publication Data

US 2003/0228227 A1 Dec. 11, 2003

(51) Int. Cl.
*F04B 35/02* (2006.01)
*F01B 11/02* (2006.01)

(52) U.S. Cl. ..... 417/53; 417/399; 417/403; 92/169.1; 92/172

(58) Field of Classification Search ..... 417/403, 417/401, 399, 53, 1, 43, 52, 44.8, 199.1, 417/199.2, 211, 212, 214, 217, 388, 400; 92/169.1, 171.1, 169.2, 169.3, 169.4, 170.1, 92/172, 171
See application file for complete search history.

(56) References Cited

U.S. PATENT DOCUMENTS

| | | | | |
|---|---|---|---|---|
| 1,961,942 | A * | 6/1934 | Pack | 164/315 |
| 2,154,529 | A | 4/1939 | Raymond | |
| 2,163,436 | A | 6/1939 | Raymond et al. | |
| 3,010,404 | A | 11/1961 | Anderson | |
| 3,288,071 | A | 11/1966 | Anderson | |
| 3,726,185 | A | 4/1973 | Orr | |
| 3,963,038 | A * | 6/1976 | Jensen | 137/99 |
| 4,829,955 | A * | 5/1989 | Strasser | 123/193 CP |
| 5,186,095 | A * | 2/1993 | Todd | 91/518 |
| 5,188,255 | A * | 2/1993 | Du | 222/1 |
| 5,390,634 | A * | 2/1995 | Walters et al. | 123/193.5 |
| 5,567,122 | A * | 10/1996 | Schulte | 417/214 |
| 5,626,467 | A * | 5/1997 | Cantley | 417/312 |
| 5,662,023 | A * | 9/1997 | Carson et al. | 92/59 |
| 6,503,066 | B1 * | 1/2003 | Cantley | 417/403 |

FOREIGN PATENT DOCUMENTS

| | | | |
|---|---|---|---|
| DE | 003105900 | A1 * | 9/1982 |
| DE | 3219416 | | 2/1983 |
| EP | 0034657 | | 9/1981 |
| GB | 1503648 | | 3/1978 |
| GB | 2096707 | | 10/1982 |

OTHER PUBLICATIONS

Kristal et al., PUMPS, 1953, McGraw-Hill, p. 248.*
"New Generation Injection Pumps," Black, Sivalls & Bryson (Canada) Limited.
PCT Search Report (mailing date of Oct. 6, 2003) from European Patent Office citing the documents listed above.

* cited by examiner

*Primary Examiner*—Charles G Freay
(74) *Attorney, Agent, or Firm*—Finnegan, Henderson, Farabow, Garrett & Dunner, L.L.P.

(57) ABSTRACT

A pumping system including a pump is disclosed. The pump includes a replacement piston and a replacement cylinder associated with the replacement piston. The replacement piston has a cross sectional area smaller than a cross sectional area of an original piston of the pump.

39 Claims, 9 Drawing Sheets

PUMPING SYSTEM, REPLACEMENT KIT INCLUDING PISTON AND/OR CYLINDER, AND METHOD FOR PUMPING SYSTEM MAINTENANCE

BACKGROUND OF THE INVENTION

This invention generally relates to a pumping system, a replacement kit for the pumping system, and a related method for maintaining the pumping system. More particularly, the present invention relates to a pumping system including a pneumatic pump having a replacement piston, a replacement kit for the pumping system, and a related method for maintaining the pumping system.

A conventional pumping system includes a pump, which delivers liquid, such as glycol, into a natural gas pipeline. Typically, the pump in such a pumping system is a pneumatic pump deriving its motive power from pressurized natural gas flowing through the natural gas pipeline. Because the natural gas used to operate the pneumatic pump is typically exhausted to the environment, many concerns have been raised regarding the effects of the exhausted natural gas.

Accordingly, there is a need in the art to minimize the amount of natural gas exhausted to the environment. There is also a related need to reduce the cost of operating a pneumatic pump driven by natural gas.

SUMMARY OF THE INVENTION

The present invention is directed to a pumping system, a replacement kit for the pumping system, and a related method for maintaining the pumping system. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

In accordance with the invention, a pumping system comprises a pump. The pump includes a replacement piston and a replacement cylinder associated with the replacement piston. The replacement piston has a cross sectional area smaller than a cross sectional area of an original piston of the pump.

In another aspect, the invention is directed to a replacement kit for a pumping system. The pumping system comprises a pump including a piston and a cylinder associated with the piston. The replacement kit comprises a replacement piston to replace the piston of the pump. The replacement piston has a cross sectional area smaller than a cross sectional area of an original piston of the pump.

In yet another aspect, the invention is directed to a replacement kit for a pumping system. The pumping system comprises a pump including a cylinder and a piston associated with the cylinder. The replacement kit comprises a replacement cylinder to replace the cylinder of the pump. The replacement cylinder includes a bore having a cross sectional area smaller than a cross sectional area of a bore of an original cylinder of the pump.

In yet another aspect, the invention is directed to a method for maintaining a pumping system. The pumping system comprises a pump including a piston and a cylinder associated with the piston. The method comprises the step of replacing the piston of the pump with a replacement piston having a cross sectional area smaller than a cross sectional area of an original piston of the pump.

In yet another aspect, the invention is directed to a method for maintaining a pumping system. The pumping system comprises a pump including a cylinder and a piston associated with the cylinder. The method comprises the step of replacing the cylinder of the pump with a replacement cylinder including a bore having a cross sectional area smaller than a cross sectional area of a bore of an original cylinder of the pump.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DETAILED DESCRIPTION

Figure 1:
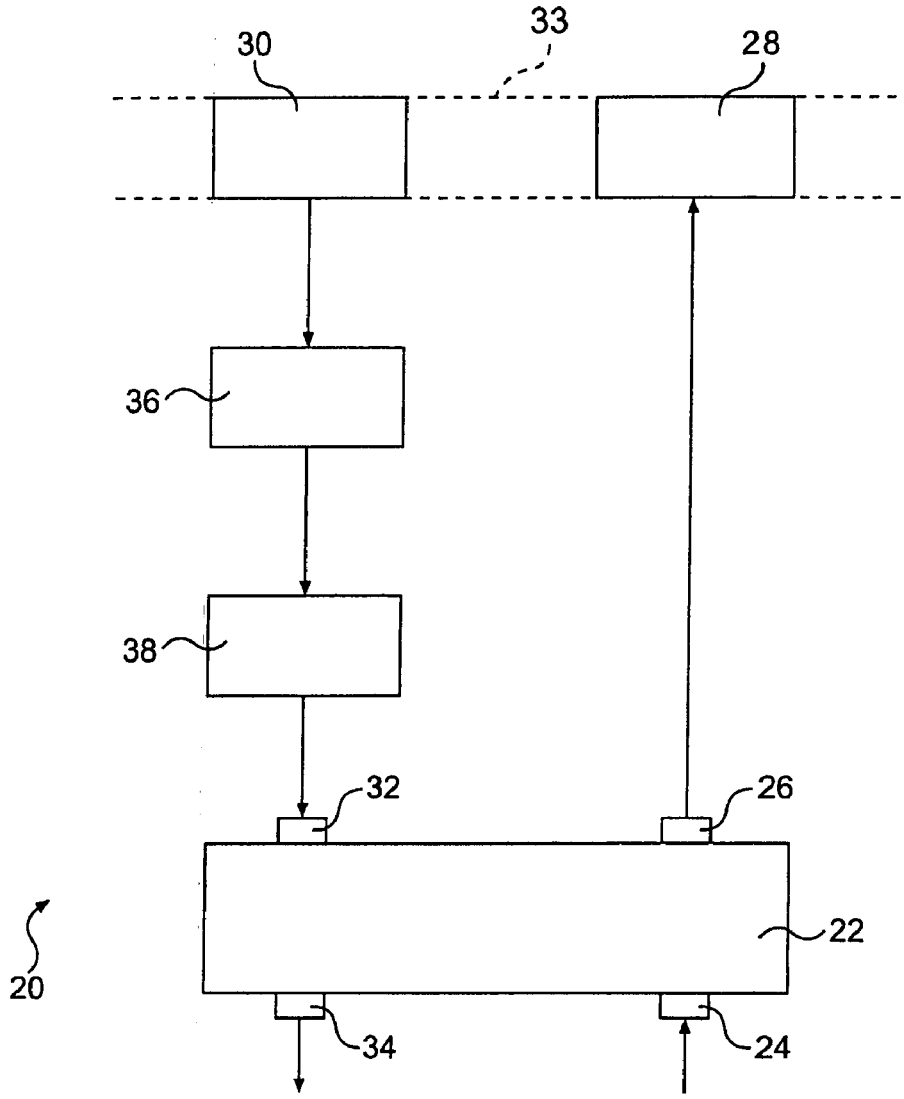
FIG. 1 is a schematic drawing of an embodiment of a pumping system according to the invention.

Reference will now be made in detail to the presently preferred embodiment of the present invention, examples of which are illustrated in the accompanying drawings. Wherever possible, the same reference numbers will be used throughout the drawings to refer to the same or like parts.

For the purposes of the following description, "an original piston of a pump" refers to either a piston installed in a pump when a manufacturer produced the pump or a piston installed in a pump when a user purchased the pump.

Similarly, for the purposes of the following description, "an original cylinder of a pump" refers to either a cylinder installed in a pump when a manufacturer produced the pump or a cylinder installed in a pump when a user purchased the pump.

In accordance with the invention, there is provided a pumping system. As embodied herein and illustrated in FIG. 1, a pumping system 20 includes a pump 22. The pump 22 may be used for pumping all types of fluid to a pumping destination 28. The types of fluid to be pumped to the pumping destination include, but are not limited to, liquid such as water, glycol, and other chemical solutions and gases such as air and natural gas. However, the pump 22 is preferably used for pumping liquid to the pumping destination 28. Although the fluid to be pumped to the pumping destination 28 is referred to as liquid in the following descriptions, gases may also be pumped to the pumping destination 28 using the pump 22.

Many different industries, including but not limited to gas, oil, and petrochemical industries, may use the pump 22 and the pumping system 20. The liquid to be pumped enters the pump 22 through a liquid inlet 24 of the pump 22 and exits through a liquid outlet 26 of the pump 22 toward the pumping destination 28. The liquid is supplied to the pump 22 from any structure, including but not limited to a storage tank and a conduit. Similarly, the pumping destination 28 may be any structure, including but not limited to a natural gas pipeline, a storage tank, and a conduit.

Many different types of pumps, including but not limited to a pneumatic pump, a hydraulic pump, and an electrical pump, may be utilized in the pumping system 20. However, the pump 22 is preferably a pneumatic pump. Accordingly, the pumping system 20 illustrated in FIG. 1 includes a pneumatic source 30 providing the necessary motive power to operate the pump 22. The pneumatic source 30 may provide many different types of pneumatic fluid, including but not limited to natural gas, air, and other types of gas, to the pump 22. The pneumatic source 30 may be a compressor increasing the pressure of the pneumatic fluid before it is supplied to the pump 22 or may be a natural gas pipeline having pressurized natural gas flowing therethrough. Accordingly, a natural gas pipeline 33 designated by a phantom line in FIG. 1 may serve as both the pneumatic source 30 and the pumping destination 28. In other words, the pump 22 may derive its motive power from the natural gas pipeline 33 and, at the same time, pump liquid to the natural gas pipeline 33.

As illustrated in FIG. 1, the pneumatic fluid supplied from the pneumatic source 30 enters the pump 22 through a fluid inlet 32. After operating the pump 22 to discharge the liquid to the pumping destination 28, the pneumatic fluid exits the pump 22 through a fluid outlet 34. The pneumatic fluid exiting the pump 22, conventionally called exhaust, may be, totally or partially, discharged to the environment directly. Instead of being discharged to the environment directly, the exhaust may be, totally or partially, utilized in other systems before being discharged to the environment. Furthermore, the exhaust may be, totally or partially, looped back to the pumping system 20. For example, if the pumping system 20 utilizes the natural gas in the natural gas pipeline 32 as the pneumatic fluid, the exhaust may be, totally or partially, looped back to the natural gas pipeline 33 after being subjected to appropriate treatment. Also, the exhaust may be, totally or partially, utilized in a line heater or in a reboiler burner.

As illustrated in FIG. 1, the pumping system 20 may include a pressure reducer 36 and a flow regulator 38. The pressure reducer 36 and the flow regulator 38 may be installed between the pneumatic source 30 and the fluid inlet 32 of the pump 22 in the order shown in FIG. 1 or they may be installed in a reverse order.

The pumping system 20 may include the pressure reducer 36 if the pressure of the pneumatic fluid supplied from the pneumatic source 30 is greater than the necessary pressure to operate the pump 22. The pump 22, however, may still operate if the pressure of the pneumatic fluid supplied from the pneumatic source 30 is greater than the necessary pressure to operate the pump 22. Accordingly, the pumping system 20 may not need the pressure reducer 36 if the pressure of the pneumatic fluid supplied from the pneumatic source 30 is greater than the necessary pressure to operate the pump 22.

Variety of known and commercially available devices, including but not limited to various valves, may be used as the pressure reducer 36. The pressure reducer 36 may be a fixed type configured to reduce a fixed pressure of the pneumatic fluid supplied from a pneumatic source to another fixed pressure. Alternatively, the pressure reducer 36 may be a variable type capable of being used with different pneumatic sources supplying pneumatic fluid at different pressures. Also, the pressure reducer 36 may be a variable type capable of being used with different pumps requiring pneumatic fluid at different pressures.

Similarly, the pumping system 20 may include the flow regulator 38 if the amount of the pneumatic fluid supplied from the pneumatic source 30 is greater than the necessary amount to operate the pump 22. The pump 22, however, may still operate if the amount of the pneumatic fluid supplied from the pneumatic source 30 is greater than the necessary amount to operate the pump 22. Accordingly, the pumping system 20 may not need the flow regulator 38 if the amount of the pneumatic fluid supplied from the pneumatic source 30 is greater than the necessary amount to operate the pump 22.

Variety of known and commercially available devices, including but not limited to various valves, may be used as the flow regulator 38. The flow regulator 38 may be a fixed type to be used with a pneumatic source supplying a fixed amount of pneumatic fluid to control the amount of the pneumatic fluid supplied to a pump at another fixed level. Alternatively, the flow regulator 38 may be a variable type capable of being used with different pneumatic sources supplying different amounts of pneumatic fluid. Also, the flow regulator 38 may be a variable type capable of controlling the amount of pneumatic fluid supplied to different pumps at different levels.

Furthermore, instead of including separate devices for reducing the pressure supplied from the pneumatic source 30 and controlling the amount of fluid supplied to the pump 22, the pumping system 20 may include a single device serving both as the pressure reducer 36 and as the flow regulator 38.

Figure 3:
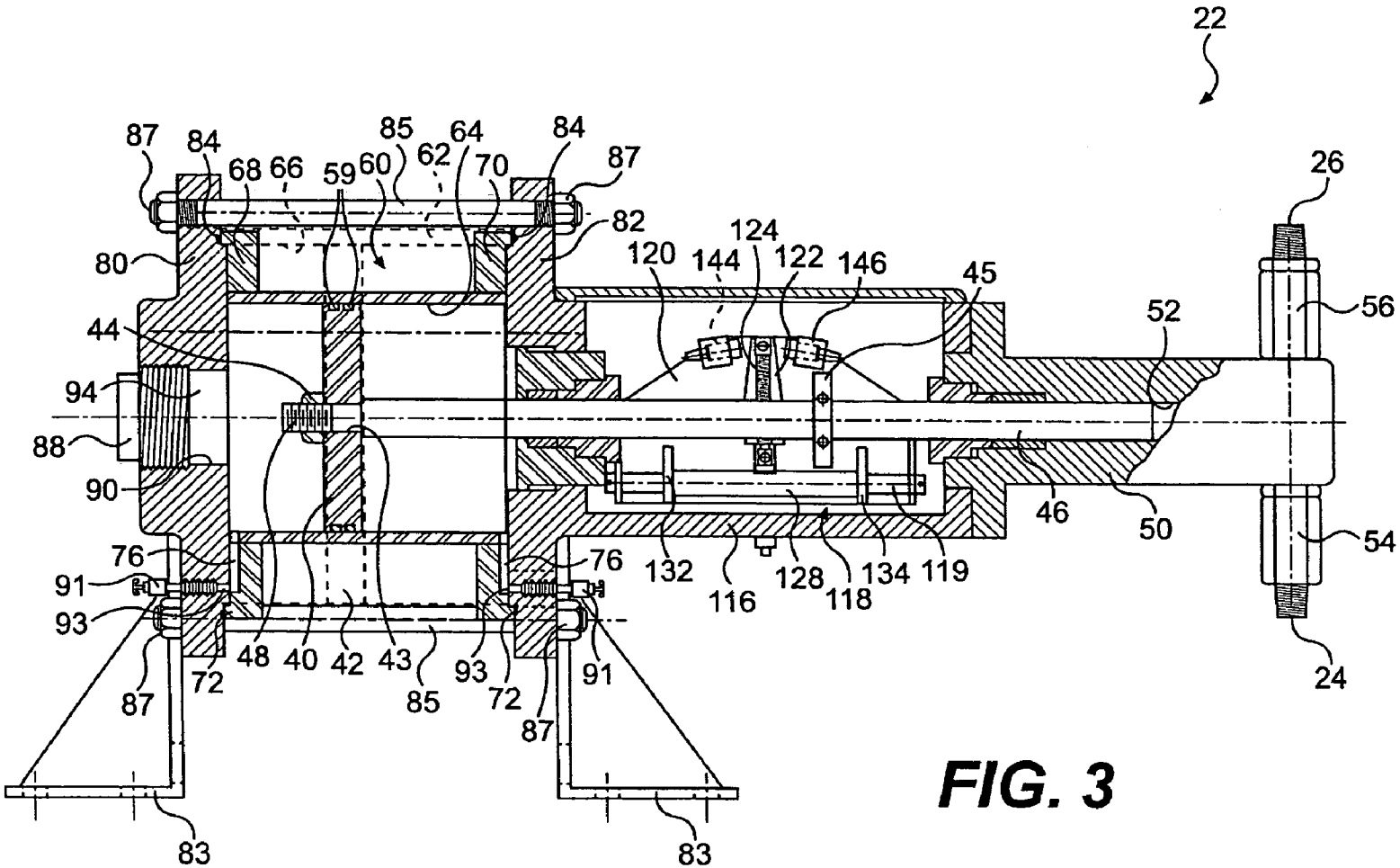
FIG. 3 is a partial sectional view of the pump taken along line III-III of FIG. 2.
Figure 4:
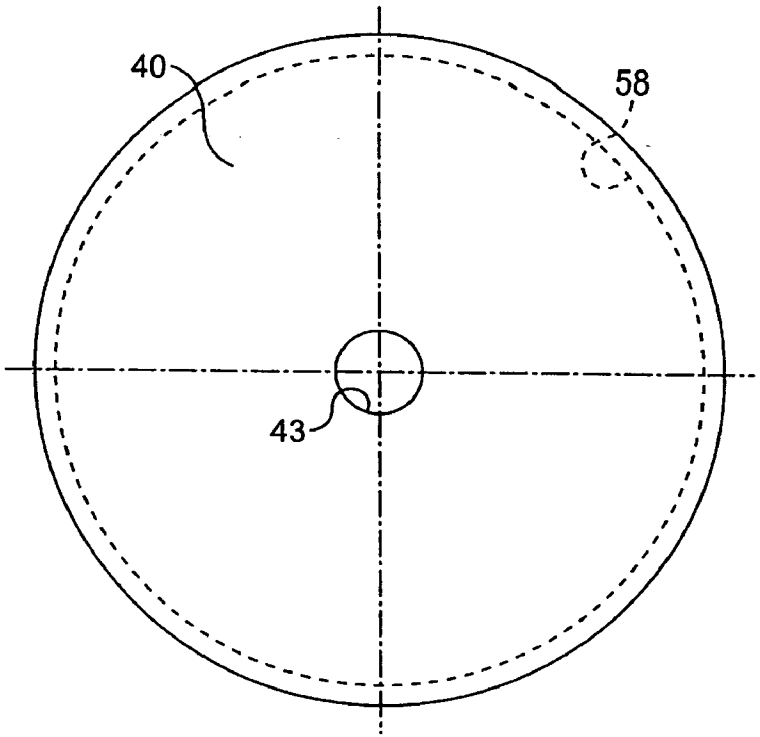
FIG. 4 is a top view of an embodiment of a replacement piston according to the invention.

In accordance with the invention and as illustrated in FIG. 3, the pump 22 includes a replacement piston 40. The replacement piston 40 replaces an original piston 42 of the pump 22 and has a cross sectional area smaller than a cross sectional area of the original piston 42 of the pump 22. The replacement piston 40 may have any cross sectional shape as long as its cross sectional area is smaller than the cross sectional area of the original piston 42. However, the replacement piston 40 preferably has a circular cross section as illustrated in FIG. 4. The diameter of the replacement piston 40 is preferably smaller than 10 inches. More preferably, the diameter of the replacement piston 40 ranges between 2 and 8 inches. For example, a replacement piston having a diameter of 6 inches may replace an original piston having a diameter of 10 inches.

Figure 5:
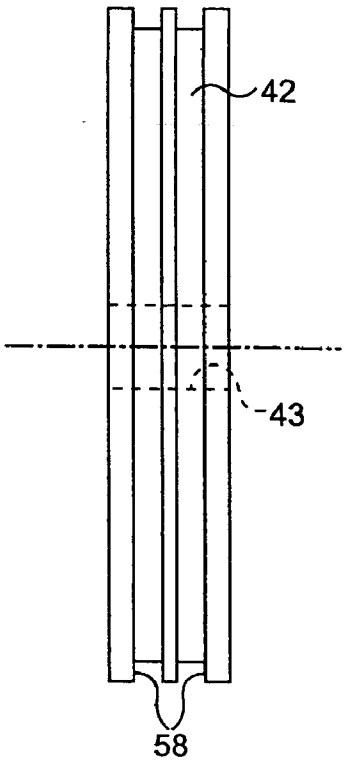
FIG. 5 is a side view of the replacement piston.

As illustrated in FIGS. 3-5, the replacement piston 40 includes a hole 43. The pump 22 further includes a plunger 46 having a threaded end 48. The threaded end 48 of the plunger 46 extends through the hole 43 of the replacement piston 40. A lock nut 44 engages the threaded end 48 of the plunger 46 and secures the plunger 46 to the replacement piston 40. The plunger 46 moves in a reciprocating motion as the replacement piston 40 moves in a reciprocating motion in response to the pneumatic fluid supplied to the pump 22. The plunger 46 further includes a travel stop 45. The function of the travel stop 45 is described in greater detail below. As illustrated in FIGS. 4 and 5, the replacement piston 40 includes grooves 58 configured to accommodate replacement piston rings 59 therein.

The pump 22 includes a pump body 50 having a chamber 52. The chamber 52 is in fluid communication with the liquid inlet 24 of the pump 22 through a check valve 54 and with the liquid outlet 26 of the pump 22 through another check valve 56. The chamber 52 accommodates part of the plunger 46 therein. As the plunger 46 moves away from the check valves 54 and 56 (to the left in FIG. 3), the liquid to be pumped enters the chamber 52 through the check value 54. The check valve 56 remains closed while the plunger 46 moves away from the check valves 54 and 56. Subsequently, as the plunger 46 moves toward the check valves 54 and 56 (to the right in FIG. 3), it pushes the liquid in the chamber 52 out through the check valve 56 and therefore pumps the liquid to the pumping destination 28 (FIG. 1). The check valve 54 remains closed while the plunger 46 moves toward the check valves 54 and 56. The plunger 46 repeats this reciprocating motion to pump the liquid to the pumping destination 28. As described above, the pumping destination 28 may be a natural gas pipeline and the liquid to be pumped to the pumping destination 28 may be glycol.

Figure 7:
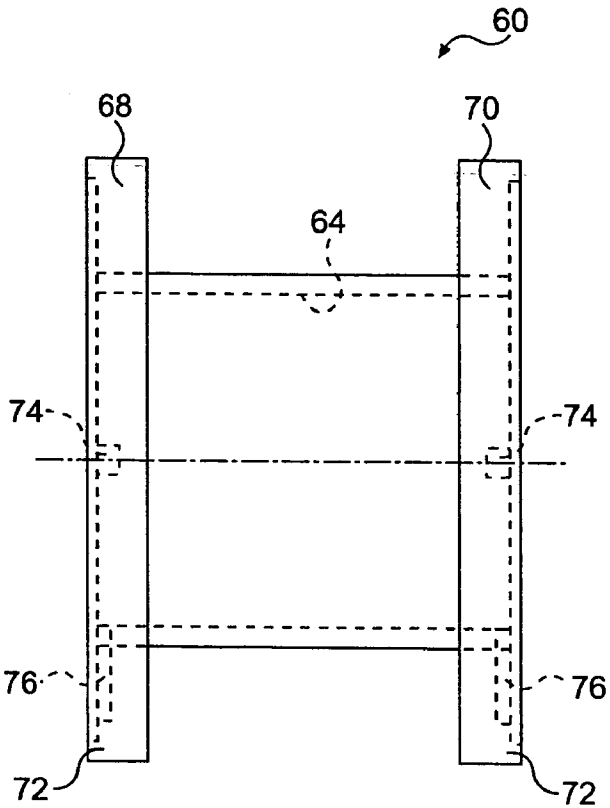
FIG. 7 is a side view of the replacement cylinder.
Figure 6:
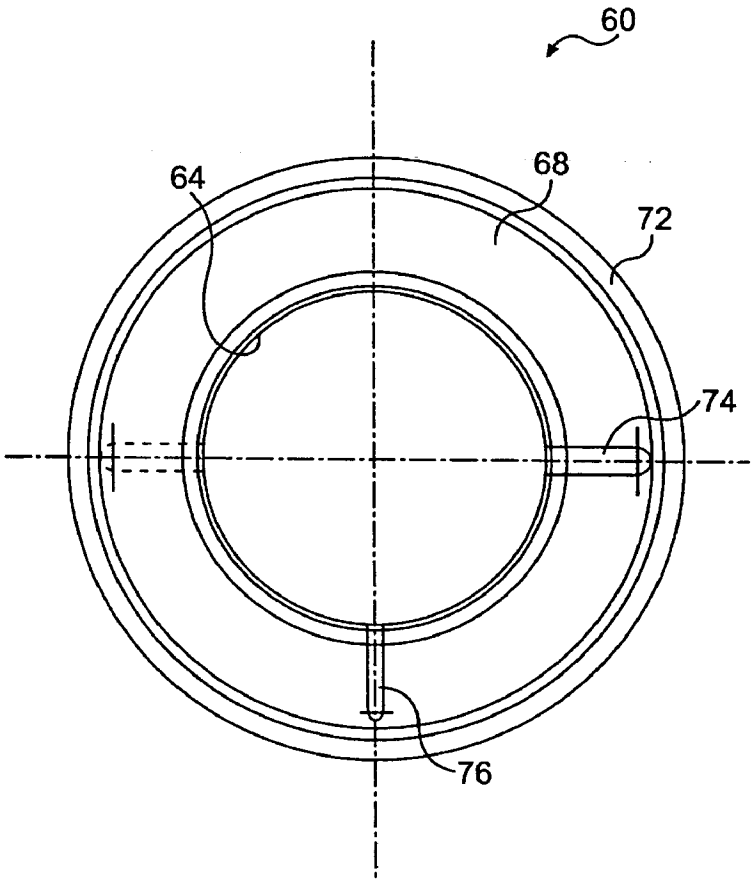
FIG. 6 is a top view of an embodiment of a replacement cylinder according to the invention.

In accordance with the invention and as illustrated in FIGS. 3, 6, and 7, the pump 22 further includes a replacement cylinder 60. The replacement cylinder 60 replaces an original cylinder 62 of the pump 22. The replacement cylinder 60 includes a bore 64 sized and shaped to accommodate the replacement piston 40 therein and to fittingly engage the piston rings 59 of the replacement piston 40. The bore 64 of the replacement cylinder 60, therefore, has a cross sectional area smaller than a cross sectional area of a bore 66 of the original cylinder 62. Also, the bore 64 of the replacement cylinder 60 has the same cross sectional shape as the cross sectional shape of the replacement piston 40.

Accordingly, if the replacement piston 40 has a circular cross section as illustrated in FIG. 4, the bore 64 of the replacement cylinder 60 also has a circular cross section as illustrated in FIG. 6. Like the replacement piston 40, the diameter of the bore of the replacement cylinder 60 is preferably smaller than 10 inches. More preferably, the diameter of the bore 64 of the replacement cylinder 60 ranges between 2 and 8 inches. For example, if a replacement piston having a diameter of 6 inches is selected to replace an original piston having a diameter of 10 inches, a replacement cylinder including a bore having a diameter of 6 inches, or slightly greater than 6 inches, should replace an original cylinder including a bore having a diameter of 10 inches, or slightly greater than 10 inches.

As illustrated in FIGS. 2, 3, 7, and 8, the replacement cylinder 60 includes a first end plate 68 and a second end plate 70 extending outwardly from the bore 64 of the replacement piston 60. The first and second end plates 68 and 70 may be manufactured separately from the cylinder body having the bore 64 and secured to the cylinder body by any known conventional methods, including but not limited to welding. Alternatively, the first and second end plates 68 and 70 may be manufactured integrally with the cylinder body by any known conventional methods, including but not limited to casting. The first end plate 68 and the second end plate 70 are configured to engage a first flange 80 and a second flange 82 of the pump 22, respectively.

An o-ring 84 is positioned in each of the first and second flanges 80 and 82 of the pump 22 where the original cylinder 62 engages them. Each of the first and second end plates 68 and 70 of the replacement cylinder 60 includes a projection 72 at a position where the original cylinder 62 engages the o-rings 84. As illustrated in FIGS. 6 and 7, the projections 72 are annular projections if the original cylinder 62 has a circular cross section. The o-rings 84 are positioned between the projections 72 of the first and second end plates 68 and 70 and the first and second flanges 80 and 82. Accordingly, the first and second end plates 68 and 70 sealingly engage the first and second flanges 80 and 82, respectively.

As illustrated in FIG. 3, the first flange 80 of the pump 22 includes a hole 90 partially provided with female threads. A plug 88 closes the hole 90 by engaging its male threads with the female threads of the hole 90. Because the female threads extends partially through the hole 90, part of the hole 90 remains hollow even after the plug 88 closes the hole 90. This hollow space 94 accommodates the lock nut 44 and the threaded end 48 of the plunger 46 when the replacement piston 40 abuts the first flange 80 of the pump 22.

Figure 2:
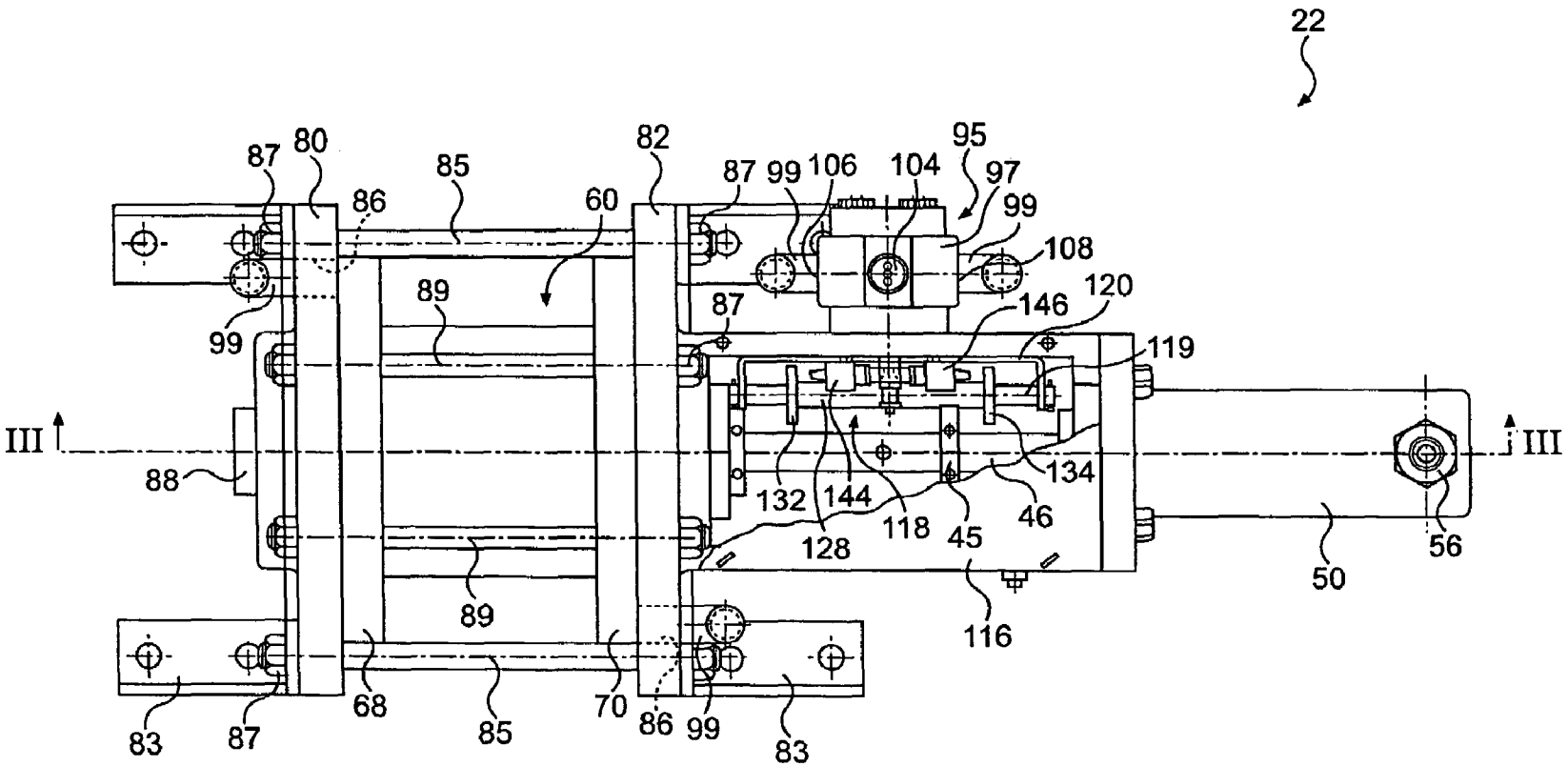
FIG. 2 is a partial sectional view of an embodiment of a pump according to the invention.

Bolts 87 engage the threaded ends of studs 85 extending through the first and second flanges 80 and 82 of the pump 22. The bolts 87 and studs 85, therefore, secure the first and second end plates 68 and 70 of the replacement cylinder 60 and the first and second flanges 80 and 82 of the pump 22 to each other. Some of the bolts 87 and the studs 85 secure legs supports 83 to the first and second flanges 80 and 82 of the pump 22. As illustrated in FIG. 2, the replacement cylinder 60 may further include cylinder studs 89 provided between the first and second end plates 68 and 70 to strengthen the structural integrity of the replacement cylinder 60.

Figure 8:
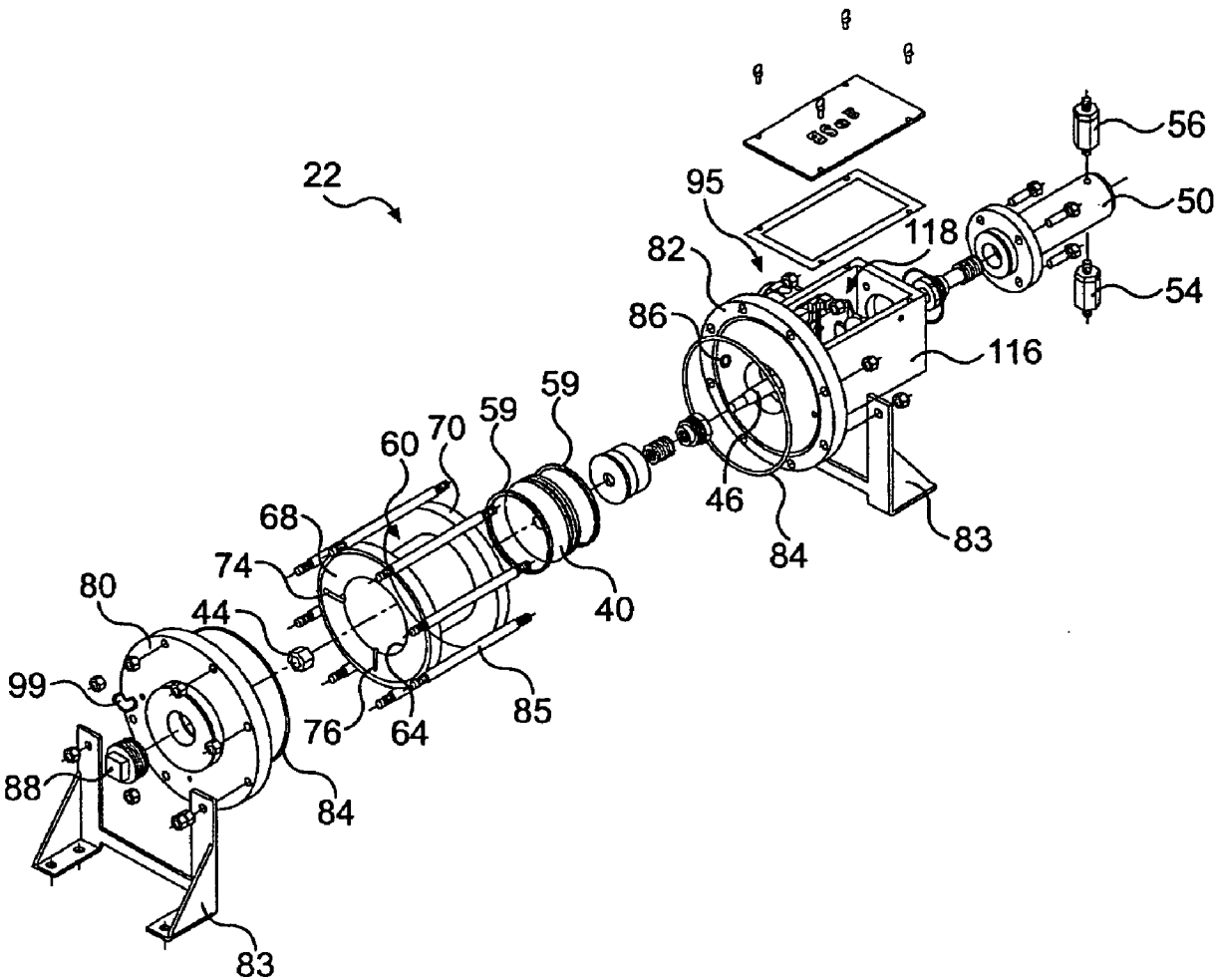
FIG. 8 is an exploded view of the pump illustrated in FIG. 2.

As illustrated in FIGS. 6-8, each of the first and second end plates 68 and 70 further includes a slot 74 in fluid communication with the bore 64 of the replacement cylinder 60. Each of the first and second flanges 80 and 82 of the pump 22 includes a port 86 extending therethrough. As explained in more detail below, each of the ports 86 is connected to the pneumatic source 30 (FIG. 1). Each slot 74 of the first and second end plates 68 and 70 is provided at a position to be aligned with each port 86 of the first and second flanges 80 and 82 of the pump 22. Accordingly, the pneumatic fluid from the pneumatic source 30 may enter the bore 64 of the replacement cylinder 60 through the ports 86 of the first and second flanges 80 and 82 and the slots 74 of the first and second end plates 68 and 70.

As illustrated in FIGS. 3 and 6-8, each of the first and second end plates 68 and 70 also includes another slot 76 in fluid communication with the bore 64 of the replacement cylinder 60. Each of the first and second flanges 80 and 82 of the pump 22 includes a hole 93 extending therethrough and a valve 91 is provided in each of the holes 93. Each slot 76 of the first and second end plates 68 and 70 is provided at a position to be aligned with each hole 93 of the first and second flanges 80 and 82 of the pump 22. Any condensation formed in the bore 64 of the replacement cylinder 60 may be drained through the slots 76 and the holes 93 by opening the valves 91.

As mentioned above, each of the ports 86 of the first and second flanges 80 and 82 is connected to the pneumatic source 30 (FIG. 1). As best illustrated in FIGS. 2 and 9-11, the pump 22 include a rotary pilot valve 95 including a valve body 97. The valve body 97 includes an inlet hole 102, an outlet hole 104, a first hole 106, and a second hole 108 all extending therethrough. The inlet hole 102 of the rotary pilot valve 95 is in fluid communication with the flow regulator 38, and therefore serves as the fluid inlet 32 of the pump 22 (FIG. 1). The outlet hole 104 of the rotary pilot valve 95, on the other hand, is in fluid communication with an exhaust line, and therefore, serves as the fluid outlet 34 of the pump 22 (FIG. 1). The first hole 106 of the rotary pilot valve 95 is in fluid communication with the port 86 of the first flange 80 through a first tube (not shown). Similarly, the second hole 108 of the rotary pilot valve 95 is in fluid communication with the port 86 of the second flange 82 of the pump 22 through a second tube (not shown). An elbow 99 may be provided in each of the ports 86 and the first and second holes 106 and 108 to connect the first and second tubes.

Figure 9:
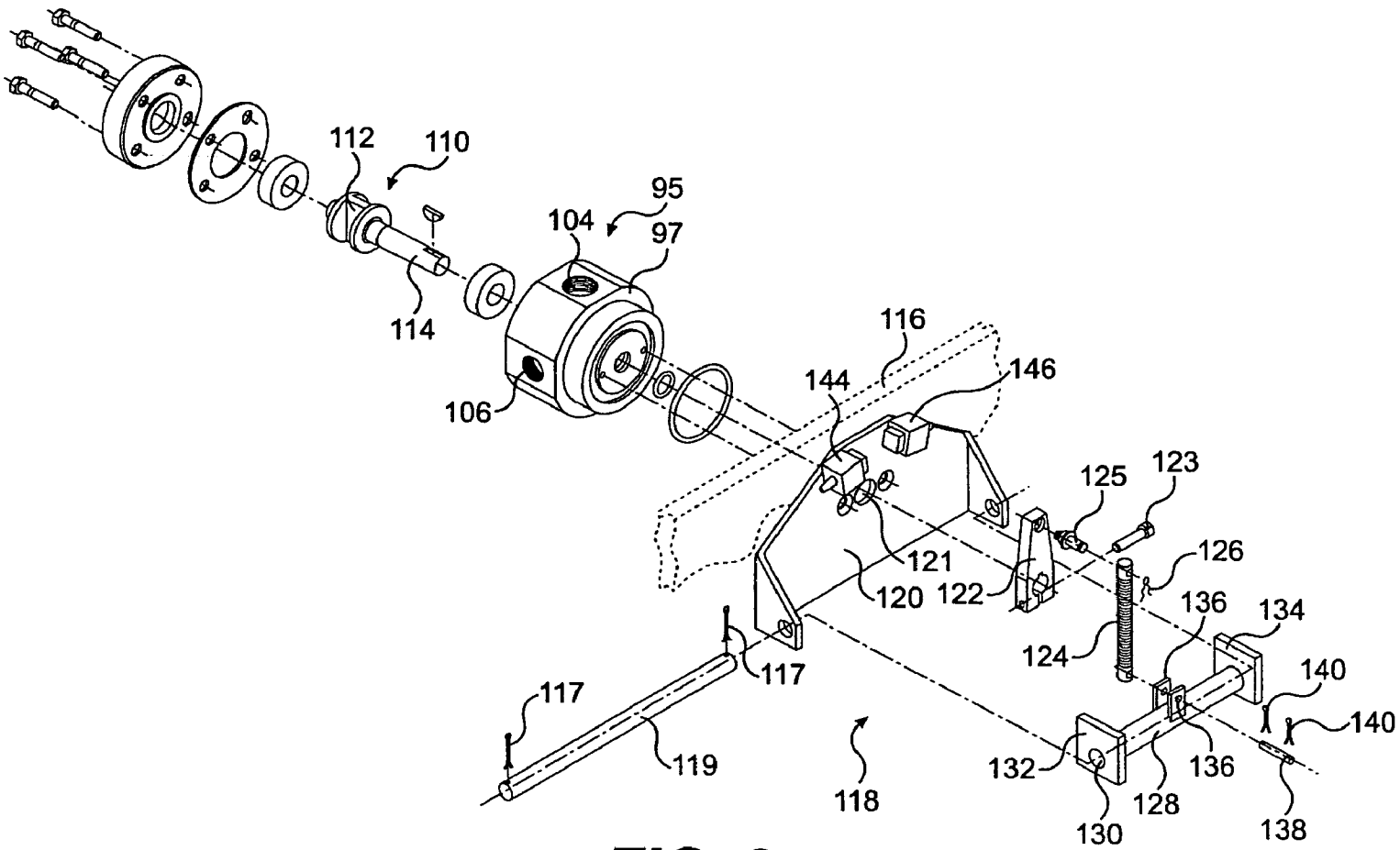
FIG. 9 is an exploded view illustrating a rotary pilot valve and a trip assembly of the pump illustrated in FIG. 2.
Figure 11:
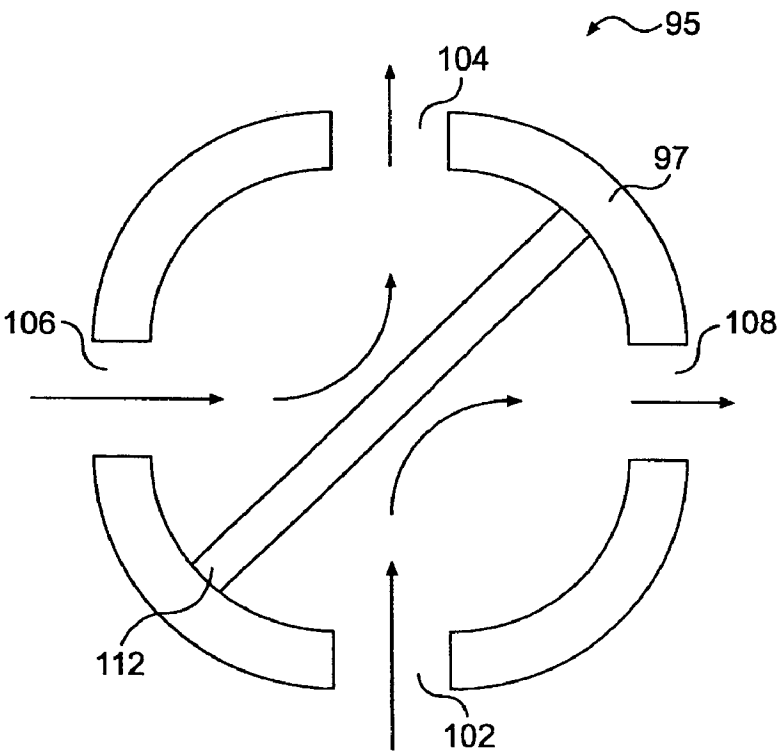
FIG. 11 is a schematic drawing illustrating a divider of the rotary pilot valve in a second position.
Figure 10:
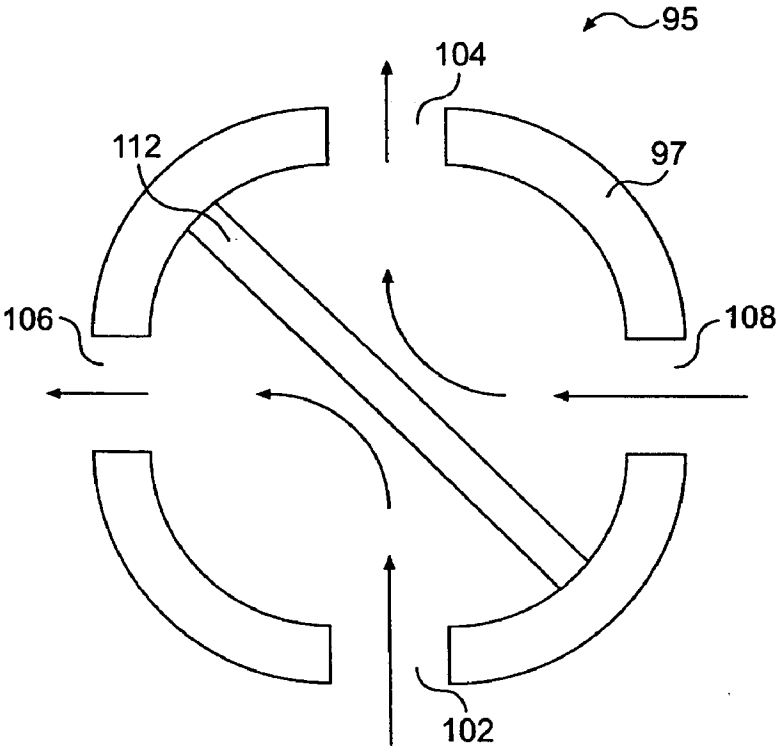
FIG. 10 is a schematic drawing illustrating a divider of the rotary pilot valve in a first position.

As illustrated in FIGS. 9-11, the rotary pilot valve 95 includes a valve member 110 having a divider 112. The divider 112 of the valve member 110 sealingly engages the inner surface of the valve body 97 and allows fluid communication between the inlet hole 102 and one of the first and second holes 106 and 108 and between the outlet hole 104 and the other of the first and second holes 106 and 108.

Accordingly, when the divider 112 of the valve member 110 is in a first position illustrated in FIG. 10, the pneumatic fluid from the flow regulator 38 (FIG. 1) enters the bore 64 of the replacement cylinder 60 through the inlet hole 102 and the first hole 106 of the valve body 97, the port 86 of the first flange 80, and the slot 74 of the first end plate 68. The pneumatic fluid then pushes one side of the replacement piston 40 toward the check valves 54 and 56 (to the right in FIG. 3). As the replacement piston 40 moves toward the check valves 54 and 56, the pneumatic fluid on the other side of the replacement piston 40 is pushed out of the pump 22 through the slot 74 of the second end plate 70, the port 86 of the second flange 82, and the second hole 108 and outlet hole 104 of the valve body 97.

When the divider 112 of the valve member 110 is in a second position illustrated in FIG. 11, the flow paths of the pneumatic fluid are reversed. In other words, the pneumatic fluid from the flow regulator 38 (FIG. 1) enters the bore 64 of the replacement cylinder 60 on the other side of the replacement piston 40 and pushes it away from the check valves 54 and 56 (to the left in FIG. 3) while the pneumatic fluid in the bore 64 of the replacement cylinder 60 on the one side of the replacement piston 40 exits the pump 22. Accordingly, depending on the position of the divider 112 of the valve member 110, one of the ports 86 serves as an inlet of the replacement cylinder 60 while the other of the ports 86 serves as an outlet of the replacement cylinder 60.

As illustrated FIG. 9, the valve member 110 includes a shaft 114. The shaft 114 rotates the divider 112 between the first and second positions illustrated in FIGS. 10 and 11. The pump 22 includes a box 116 enclosing a trip assembly 118 therein. The trip assembly 118 is connected to the shaft 114 of the valve member 110 and rotates the shaft 114 to rotate the divider 112 between the first and second positions illustrated in FIGS. 10 and 11.

The trip assembly 118 includes a bumper 120 and a rod 119 secured to the bumper 120 using a pair of cotter pins 117. The bumper 120 includes a first stop 144 and a second stop 146. The trip assembly 118 further includes a trip arm 122 having first and second ends. The shaft 114 of the valve member 110 extends through a hole 121 provided in the bumper 120 and is secured to the first end of the trip arm 122 using a cap screw 123. The trip assembly 118 further includes a trip spring 124 having first and second ends. The first end of the trip spring 124 is secured to the second end of the trip arm 122 using a clevis pin 125 and a hair pin cotter 126. As described in greater detail below, the second end of the trip arm 122 is rotatable between the first and second stops 144 and 146 of the bumper 120.

The trip assembly 118 further includes a sleeve 128 having projections 136. While the first end of the trip spring 124 is secured to the trip arm 122, the second end of the trip spring 124 is secured to the projections 136 of the sleeve 128 using a cylindrical pin 138 and a pair of cotter pins 140. The sleeve 128 further includes a hole 130 and first and second end flanges 132 and 134. The rod 119 is inserted through the hole 130 of the sleeve 128 and the first and second end flanges 132 and 134 are sized to selectively engage the travel stop 45 of the plunger 46. Accordingly, the sleeve 128 is movable along the rod 119 toward and away from the check valves 54 and 56 (to the left and right of FIG. 3) as the travel stop 45 of the plunger 46 selectively engages the first and second end flanges 132 and 134 of the sleeve 128.

As describe above, while the replacement piston 40 and plunger 46 move away from the check valves 54 and 56 (to the left of FIG. 3), the divider 112 of the valve member 110 remains in the second position illustrated in FIG. 11 and the liquid to be pumped enters the chamber 52 of the pump body 50 through the check valve 54. As the replacement piston 40 and plunger 46 near the end of their movement away from the check valves 54 and 56, the travel stop 45 of the plunger 46 engages and pushes the first end flange 132 of the sleeve 128 away from the check valves 54 and 56. The projections 136 in turn pull and bend the second end of the trip spring 124 away from the check valves 54 and 56.

When the travel stop 45 of the plunger 46 reaches its leftmost position, the biasing force generated by the bending of the trip spring 124 rotates the first end of the trip spring 124 toward the check valves 54 and 56. The trip spring 124 thereby regains its neutral configuration (i.e., the configuration without any bending). The second end of the trip arm 122, which is secured to the first end of the trip spring 124, in turn rotates toward the check valves 54 and 56 and engages the second stop 146 of the bumper 120. Finally, the shaft 114 of the valve member 110, which is secured to the first end of the trip arm 122, rotates toward the check valves 54 and 56 and rotates the divider 112 of the valve member 110 to the first position shown in FIG. 10. As a result, the port 86 of the first flange 80 is in fluid communication with the pneumatic fluid supplied from the flow regulator 38 (FIG. 1) and the replacement piston 40 and plunger 46 begin to move toward the check valves 54 and 56.

On the other hand, while the replacement piston 40 and plunger 46 move toward the check valves 54 and 56 (to the right of FIG. 3), the divider 112 of the valve member 110 remains in the first position illustrated in FIG. 10 and the liquid in the chamber 52 of the pump body 50 exits through the check valve 56 toward the pumping destination 28 (FIG. 1). As the replacement piston 40 and plunger 46 near the end of their movement toward the check valves 54 and 56, the travel stop 45 of the plunger 46 engages and pushes the second end flange 134 of the sleeve 128 toward the check valves 54 and 56. The projections 136 in turn pull and bend the second end of the trip spring 124 toward the check valves 54 and 56.

When the travel stop 45 of the plunger 46 reaches its rightmost position, the biasing force generated by the bending of the trip spring 124 rotates the first end of the trip spring 124 away from the check valves 54 and 56. The trip spring 124 thereby regains its neutral configuration. The second end of the trip arm 122, which is secured to the first end of the trip spring 124, in turn rotates away from the check valves 54 and 56 and engages the first stop 144 of the bumper 120. Finally, the shaft 114 of the valve member 110, which is secured to the first end of the trip arm 122, rotates away from the check valves 54 and 56 and rotates the divider 112 of the valve member 110 back to the second position shown in FIG. 11. As a result, the port 86 of the second flange 82 is again in fluid communication with the pneumatic fluid supplied from the flow regulator 38 (FIG. 1). At this point, a single pump cycle is completed and the next pump cycle begins.

For a pumping system requiring certain liquid discharge pressure and liquid flow rate, a suitable pump may be selected to satisfy the pumping system requirements. However, many pumping systems utilize a pump having an original piston that is larger than necessary to deliver the required liquid discharge pressure and liquid flow rate. For example, many pumping systems utilizing a pump having an original piston diameter of 10 inches do not require the maximum liquid discharge pressure and liquid flow rate that the 10 inch original piston is capable of delivering. Accordingly, a pump having an original piston diameter of 10 inches consumes more pneumatic fluid than necessary to satisfy the pumping system requirements. If, for example, natural gas serves as the pneumatic fluid, it is not only costly but also environmentally harmful to consume more than the minimum amount necessary to satisfy the pumping system requirements. Therefore, replacing the original piston 42 with the replacement piston 40 may deliver the required liquid discharge pressure and liquid flow rate and, at the same time, consume less pneumatic fluid.

Table 1 illustrates exemplary saving in pneumatic fluid that may be achievable by replacing an original piston having a diameter of 10 inches with a replacement piston having a diameter of 6 inches. It lists experimental results obtained by using air as the pneumatic fluid and provides potential saving that may be achievable in other pneumatic fluid, such as natural gas. It is provided solely for the purpose of illustrating potential saving in pneumatic fluid and, by no means, should be construed to limit the scope of the invention.

As illustrated in Table 1, for the same liquid discharge pressure and liquid flow rate, approximately 60% of pneumatic fluid may be saved by replacing an original piston having a diameter of 10 inches with a replacement piston having a diameter of 6 inches.

Accordingly, in accordance with the invention, a pumping system may be retrofitted by replacing an original piston with a replacement piston having a cross sectional area smaller than that of the original piston. An original cylinder must also be replaced with a replacement cylinder when the original piston is replaced.

After retrofitted with replacement piston and cylinder, however, a pumping system may be further retrofitted with other replacement pistons and cylinders. For example, after retrofitted with 6 inch replacement piston and cylinder from 10 inch original piston and cylinder, a pumping system may be further retrofitted by replacing the 6 inch replacement piston and cylinder with 8 inch replacement piston and cylinder.

Subsequently, should a replacement piston need replacement, it may be replaced with another replacement piston of the same size to maintain the pumping system in good working condition. Similarly, should a replacement cylinder need replacement, it may be replaced with another replacement cylinder of the same size to maintain the pumping system in good working condition. Therefore, in accordance with the invention, a replacement kit for a pumping system may include a replacement piston alone, a replacement cylinder alone, or a combination of a replacement piston and a replacement cylinder.

As described above, the pumping system 20 includes the flow regulator 38, which controls the amount of pneumatic fluid supplied to the pump 22. The saving in pneumatic fluid is maximized when the flow regulator 38 allows only the minimum amount of pneumatic fluid required to deliver the specified liquid discharge pressure and liquid flow rate to the pump 22. For specified liquid discharge pressure and liquid flow rate, a minimum pneumatic fluid supply pressure and a minimum pneumatic fluid flow rate may be determined from analytical calculations, from experimental observations, or from a combination of analytical calculations and experi-

TABLE 1

| Pneumatic Fluid Pressure | | 10 Inch Original Piston | | 6 Inch Replacement Piston | | Liquid | Pneumatic Fluid Consumption in Standard Cubic Feet Per Hour (scfh) | | Pneumatic Fluid Saving |
|---|---|---|---|---|---|---|---|---|---|
| Supply Pressure (psi) | Back Pressure (psi) | Cycle Per Minute (cpm) | Gallon Per Hour (gph) | Cycle Per Minute (cpm) | Gallon Per Hour (gph) | Discharge Pressure (psi) | 10 Inch Original Piston | 6 Inch Replacement Piston | (Adjusted to same gph) |
| 20 | 0 | 16.5 | 20.20 | 33 | 40.39 | 500 | 1300 | 996 | 62% |
| 20 | 0 | 15 | 18.36 | 19 | 23.26 | 1000 | 1250 | 614 | 62% |
| 40 | 0 | 19 | 23.26 | 34 | 41.62 | 500 | 2129 | 1271 | 66% |
| 40 | 0 | 18 | 22.03 | 32 | 39.17 | 1000 | 2129 | 1250 | 67% |
| 40 | 0 | 15 | 18.36 | 25 | 30.60 | 1800 | 2129 | 1250 | 65% |
| 60 | 0 | 18 | 22.03 | 28 | 34.27 | 1800 | 2692 | 2310 | 45% |
| 80 | 0 | 18 | 22.03 | 40 | 48.96 | 1000 | 3686 | 3051 | 64% |
| 80 | 0 | 18 | 22.03 | 34 | 41.62 | 1800 | 3549 | 2500 | 62% |

mental observations. Accordingly, if the fixed types described above are to be installed, the pressure reducer 36 and the flow regulator 38 should be selected to supply at least the minimum pneumatic fluid supply pressure and minimum pneumatic fluid flow rate to the pump 22. If variable types are installed, the settings of the pressure reducer 36 and the flow regulator 38 should be adjusted to supply at least the minimum pneumatic fluid supply pressure and minimum pneumatic fluid flow rate to the pump 22.

Table 2 illustrates an exemplary minimum pneumatic fluid supply pressure and an exemplary minimum pneumatic fluid flow rate calculated for an exemplary pumping system. The exemplary pumping system requires liquid discharge pressure of 1000 psi and liquid flow rate of 10 gph. It is provided solely for the purpose of assisting the understanding of the invention and, by no means, should be construed to limit the scope of the invention.

TABLE 2

| | 6 Inch Replacement Piston |
|---|---|
| Minimum Pneumatic Fluid Supply Pressure (psi) | 40.2 |
| Minimum Pneumatic Fluid Flow Rate (scfh) | 189.26 |

According to Table 2, if the exemplary pumping system includes a pump having a 6 inch replacement piston, the pressure regulator 36 and the flow regulator 38 should be selected or adjusted to provide pneumatic fluid at 40.2 psi and 189.26 scfh. Such selection or adjustment will produce the maximum saving in pneumatic fluid while satisfying the pumping requirements. The pressure regulator 36 and the flow regulator 38 may, of course, be selected or adjusted slightly above the calculated minimum values for reliable pump operation.

Therefore, in accordance with the invention, a replacement kit for a pumping system may further include a pressure reducer, a flow regulator, or both. The pressure reducer and flow regulator are to be installed between a pneumatic source and a pump for optimizing the pumping system.

Figure 12:
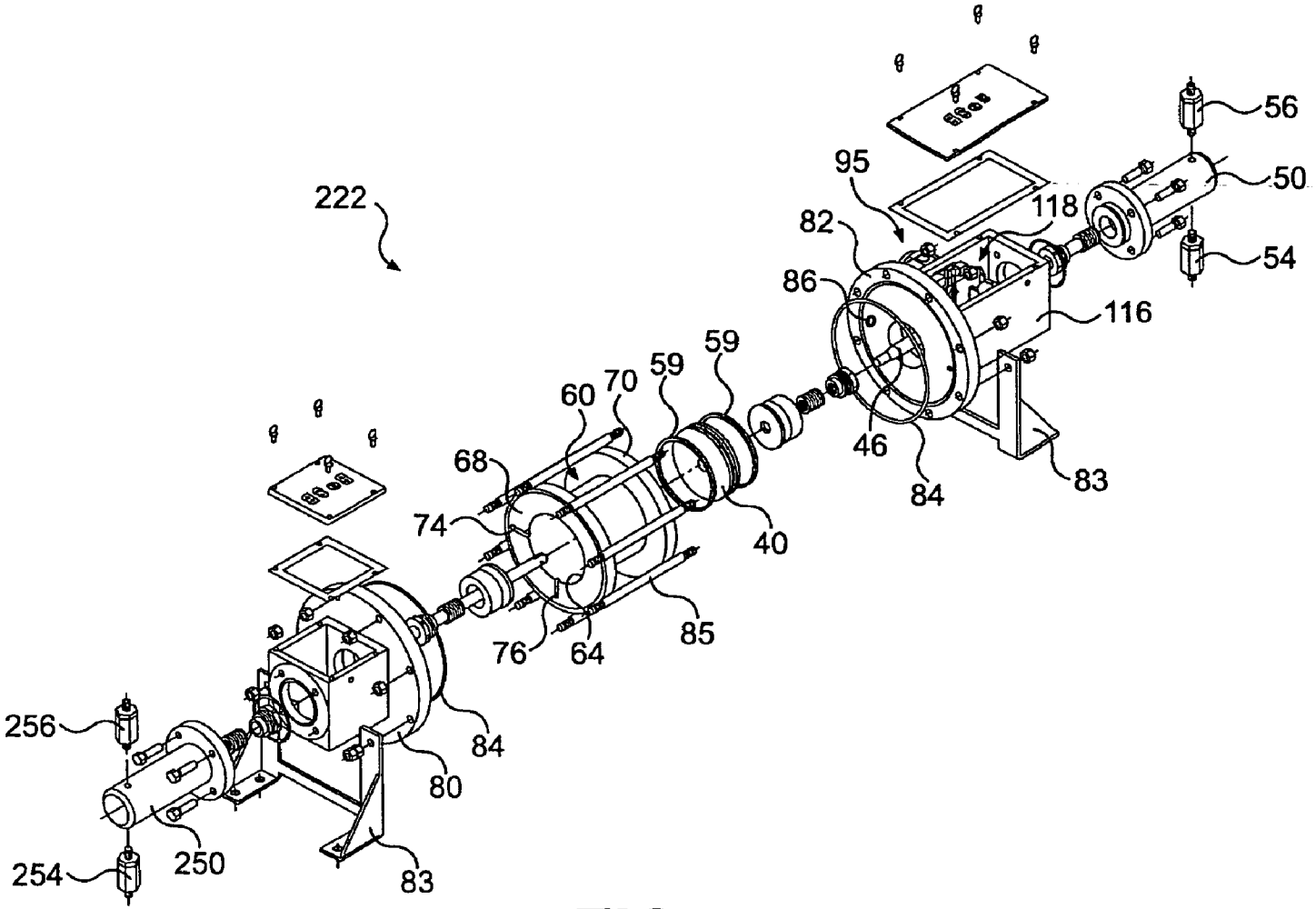
FIG. 12 is an exploded view of another embodiment of a pump according to the invention.

FIG. 12 illustrates another exemplary embodiment of a pump including a replacement piston and a replacement cylinder. Instead of the pump 22, a pump 222 illustrated in FIG. 12 may be used in the pumping system 20 illustrated in FIG. 1. The pump 222 includes another pump body 250 and another pair of check valves 254 and 256. Like the pump body 50, the pump body 250 is in fluid communication with the pumping destination 28 through the check valve 256. Also, like the check valve 54, the liquid to be pumped enters the pump body 250 through the check valve 254. Accordingly, the pump 222 outputs twice the amount of liquid per pump cycle compared with the pump 22. Other than the pump body 250 and the check valves 254 and 256, other structural features of the pump 222 are substantially the same as the pump 22. The pump 222 operates exactly the same as the pump 22.

It will be apparent to those skilled in the art that various modifications and variations can be made in the device of the present invention without departing from the scope or spirit of the invention. Other embodiments of the invention will be apparent to those skilled in the art from consideration of the specification and practice of the invention disclosed herein.

What is claimed is:

1. In a pumping system comprising:

a pump including an original piston, the improvement comprising:

a replacement piston having two opposite ends, and a replacement cylinder associated with the replacement piston, fluid acting on one of the two opposite ends causing the replacement piston to move in a first direction and fluid acting on the other of the two opposite ends causing the replacement piston to move in a second direction opposite to the first direction, wherein a cross sectional area of the replacement piston, as installed, at a position between the two opposite ends is smaller than a cross sectional area of the original piston of the pump at a corresponding position.

2. The pumping system of claim 1, wherein the replacement piston has a circular cross section.

3. In a pumping system comprising:

a pneumatic source;

a pump including an original; and first and second flanges each including a port connected to the pneumatic source, the improvement comprising:

a replacement piston having two opposite ends, and a replacement cylinder associated with the replacement piston, fluid from the pneumatic source acting on one of the two opposite ends causing the replacement piston to move in a first direction and fluid from the pneumatic source acting on the other of the two opposite ends causing the replacement piston to move in a second direction opposite to the first direction, the replacement piston, as installed, having a cross sectional area smaller than a cross sectional area of the original piston of the pump.

4. The pumping system of claim 3, further comprising a flow regulator installed between the pneumatic source and the pump to control the amount of fluid supplied from the pneumatic source to the pump.

5. A pumping system comprising:

a pneumatic source; and a pump including first and second flanges each including a port connected to the pneumatic source, a replacement piston, and a replacement cylinder associated with the replacement piston, the replacement piston having a cross sectional area smaller than a cross sectional area of an original piston of the pump, wherein the replacement cylinder includes first and second end plates extending outwardly from a bore of the replacement cylinder, each of the first and second end plates including a slot in fluid communication with the bore of the replacement cylinder, each slot being aligned with the port of the first and second flanges of the pump.

6. The pumping system of claim 5, wherein each of the first and second flanges of the pump includes a hole and each of the first and second end plates of the replacement cylinder includes a second slot in fluid communication with the bore of the replacement cylinder and aligned with the hole of the first and second flanges of the pump.

7. The pumping system of claim 5, wherein each of the first and second flanges of the pump includes an o-ring and each of the first and second end plates of the replacement cylinder includes a projection engaging the o-ring of the first and second flanges of the pump.

8. A replacement kit for a pumping system, the pumping system comprising a pump including a piston and a cylinder associated with the piston, the replacement kit comprising:

a replacement piston to replace the piston of the pump, the replacement piston having two opposite ends, fluid acting on one of the two opposite ends causing the replacement piston to move in a first direction and fluid acting on the other of the two opposite ends causing the replacement piston to move in a second direction opposite to the first direction, wherein a cross sectional area of the replacement piston at a position between the two opposite ends is smaller than a cross sectional area of the original piston of the pump at a corresponding position.

9. The replacement kit of claim 8, wherein the replacement piston has a circular cross section.

10. The replacement kit of claim 8, further comprising a replacement cylinder associated with the replacement piston to replace the cylinder of the pump.

11. A replacement kit for a pumping system, the pumping system comprising a pump including a piston, a cylinder associated with the piston, and first and second flanges each including a port, the replacement kit comprising:

a replacement piston to replace the piston of the pump, the replacement piston having a cross sectional area smaller than a cross sectional area of the original piston of the pump; and a replacement cylinder associated with the replacement piston to replace the cylinder of the pump, the replacement cylinder including first and second end plates extending outwardly from a bore of the replacement cylinder, each of the first and second end plates including a slot in fluid communication with the bore of the replacement cylinder and configured to align with the port of the first and second flanges of the pump.

12. The replacement kit of claim 11, wherein each of the first and second flanges of the pump includes a hole and each of the first and second end plates includes a second slot in fluid communication with the bore of the replacement cylinder and configured to align with the hole of the first and second flanges of the pump.

13. The replacement kit of claim 11, wherein each of the first and second flanges of the pump includes an o-ring and each of the first and second end plates of the replacement cylinder includes a projection configured to engage the o-ring of the first and second flanges of the pump.

14. The replacement kit of claim 11, wherein the pumping system includes a pneumatic source connected to the pump and the replacement kit further comprises a flow regulator installable between the pneumatic source and the pump to control the amount of fluid supplied to the pump from the pneumatic source.

15. A replacement kit for a pumping system, the pumping system comprising a pump including a cylinder and a piston associated with the cylinder, the replacement kit comprising:

a replacement cylinder to replace the cylinder of the pump, the replacement cylinder including a bore sized to accommodate a replacement piston therein and two slots in fluid communication with the bore, the two slots being positioned at opposite sides of the replacement cylinder such that fluid entering the bore through one of the two slots causes the replacement piston to move in a first direction and fluid entering the bore through the other of the two slots causes the replacement piston to move in a second direction opposite to the first direction, the bore having a cross sectional area smaller than a cross sectional area of a bore of the original cylinder of the pump.

16. The replacement kit of claim 15, wherein the bore of the replacement cylinder has a circular cross section.

17. The replacement kit of claim 15, further comprising the replacement piston to replace the piston of the pump.

18. A replacement kit for a pumping system, the pumping system comprising a pump including a cylinder, a piston associated with the cylinder, and first and second flanges each including a port, the replacement kit comprising:

a replacement cylinder to replace the cylinder of the pump, the replacement cylinder including a bore having a cross sectional area smaller than a cross sectional area of a bore of the original cylinder of the pump and first and second end plates extending outwardly from the bore of the replacement cylinder, each of the first and second end plates including a slot in fluid communication with the bore of the replacement cylinder and configured to align with the port of the first and second flanges of the pump.

19. The replacement kit of claim 18, wherein each of the first and second flanges of the pump includes a hole and each of the first and second end plates includes a second slot in fluid communication with the bore of the replacement cylinder and configured to align with the hole of the first and second flanges of the pump.

20. The replacement kit of claim 18, wherein each of the first and second flanges of the pump includes an o-ring and each of the first and second end plates of the replacement cylinder includes a projection configured to engage the o-ring of the first and second flanges of the pump.

21. The replacement kit of claim 18, wherein the pumping system includes a pneumatic source connected to the pump and the replacement kit further comprises a flow regulator installable between the pneumatic source and the pump to control the amount of fluid supplied to the pump from the pneumatic source.

22. A method for maintaining a pumping system, the pumping system comprising a pump including a piston and a cylinder associated with the piston, the method comprising the step of:

replacing the piston of the pump with a replacement piston having two opposite ends, fluid acting on one of the two opposite ends causing the replacement piston to move in a first direction and fluid acting on the other of the two opposite ends causing the replacement piston to move in a second direction opposite to the first direction, wherein a cross sectional area of the replacement piston at a position between the two opposite ends is smaller than a cross sectional area of the original piston of the pump at a corresponding position.

23. The method of claim 22, wherein the piston of the pump is the original piston of the pump.

24. The method of claim 22, wherein the replacement piston has a circular cross section.

25. The method of claim 22, further comprising the step of replacing the cylinder of the pump with a replacement cylinder associated with the replacement piston.

26. A method for maintaining a pumping system, the pumping system comprising a pneumatic source and a pump, the pump including a piston, a cylinder associated with the piston, and a first and second flanges each including a port connected to the pneumatic source, the method comprising the steps of:

replacing the piston of the pump with a replacement piston having two opposite ends, fluid from the port of the first flange acting on one of the two opposite ends causing the replacement piston to move in a first direction and fluid from the port of the second flange acting on the other of the two opposite ends causing the replacement piston to move in a second direction opposite to the first direction, the replacement piston having a cross sectional area smaller than a cross sectional area of the original piston of the pump; and replacing the cylinder of the pump with a replacement cylinder associated with the replacement piston.

27. The method of claim 26, further comprising the step of installing a flow regulator between the pneumatic source and the pump to control the amount of fluid supplied from the pneumatic source to the pump.

28. A method for maintaining a pumping system, the pumping system comprising a pneumatic source and a pump, the pump including a piston, a cylinder associated with the piston, and a first and second flanges each including a port connected to the pneumatic source, the method comprising the steps of:

replacing the piston of the pump with a replacement piston, the replacement piston having a cross sectional area smaller than a cross sectional area of the original piston of the pump; and replacing the cylinder of the pump with a replacement cylinder associated with the replacement piston, the replacement cylinder including first and second end plates extending outwardly from a bore of the replacement cylinder, each of the first and second end plates including a slot in fluid communication with the bore of the replacement cylinder, each slot being configured to align with the port of the first and second flanges of the pump, wherein the step of replacing the cylinder of the pump with the replacement cylinder includes the steps of:

aligning the slots of the first and second end plates of the replacement cylinder with the ports of the first and second flanges of the pump; and securing the first and second flanges of the pump and the first and second end plates of the replacement cylinder to each other.

29. The method of claim 28, wherein each of the first and second flanges of the pump includes a hole, each of the first and second end plates includes a second slot in fluid communication with the bore of the replacement cylinder and configured to align with the hole of the first and second flanges of the pump, and the step of aligning the slots of the first and second end plates with the ports of the first and second flanges also aligns the second slots of the first and second end plates with the holes of the first and second flanges.

30. The method of claim 28, wherein each of the first and second flanges of the pump includes an o-ring, each of the first and second end plates of the replacement cylinder includes a projection configured to engage the o-ring of the first and second flanges of the pump, and the step of replacing the cylinder of the pump with the replacement cylinder further includes the step of engaging the projections of the first and second end plates with the o-rings of the first and second flanges.

31. A method for maintaining a pumping system, the pumping system comprising a pump including a cylinder and a piston associated with the cylinder, the method comprising the step of:

replacing the cylinder of the pump with a replacement cylinder, the replacement cylinder including a bore sized to accommodate a replacement piston therein and two slots in fluid communication with the bore, the two slots being positioned at opposite sides of the replacement cylinder such that fluid entering the bore through one of the two slots causes the replacement piston to move in a first direction and fluid entering the bore through the other of the two slots causes the replacement piston to move in a second direction opposite to the first direction, the bore having a cross sectional area smaller than a cross sectional area of a bore of the original cylinder of the pump.

32. The method of claim 31, wherein the cylinder of the pump is the original cylinder of the pump.

33. The method of claim 31, wherein the bore of the replacement cylinder has a circular cross section.

34. The method of claim 31, further comprising the step of replacing the piston of the pump with the replacement piston.

35. A method for maintaining a pumping system, the pumping system comprising a pneumatic source and a pump, the pump including a cylinder, a piston associated with the cylinder, and first and second flanges each including a port connected to the pneumatic source, the method comprising the step of:

replacing the cylinder of the pump with a replacement cylinder including a bore, fluid entering the bore through the port of the first flange causing the piston to move in a first direction and fluid entering the bore through the port of the second flange causing the piston to move in a second direction opposite to the first direction, the bore having a cross sectional area smaller than a cross sectional area of a bore of the original cylinder of the pump.

36. The method of claim 35, further comprising the step of installing a flow regulator between the pneumatic source and the pump to control the amount of fluid supplied from the pneumatic source to the pump.

37. A method for maintaining a pumping system, the pumping system comprising a pneumatic source and a pump, the pump including a cylinder, a piston associated with the cylinder, and first and second flanges each including a port connected to the pneumatic source, the method comprising the step of:

replacing the cylinder of the pump with a replacement cylinder, the replacement cylinder including a bore having a cross sectional area smaller than a cross sectional area of a bore of the original cylinder of the pump, the replacement cylinder including first and second end plates extending outwardly from the bore of the replacement cylinder, each of the first and second end plates including a slot in fluid communication with the bore of the replacement cylinder, each slot being configured to align with the port of the first and second flanges of the pump, wherein the step of replacing the cylinder of the pump with the replacement cylinder includes the steps of:

aligning the slots of the first and second end plates of the replacement cylinder with the ports of the first and second flanges of the pump; and securing the first and second flanges of the pump and the first and second end plates of the replacement cylinder to each other.

38. The method of claim 37, wherein each of the first and second flanges of the pump includes a hole, each of the first and second end plates includes a second slot in fluid communication with the bore of the replacement cylinder and configured to align with the hole of the first and second flanges of the pump, and the step of aligning the slots of the first and second end plates with the ports of the first and second flanges also aligns the second slots of the first and second end plates with the holes of the first and second flanges.

39. The method of claim 37, wherein each of the first and second flanges of the pump includes an o-ring, each of the first and second end plates of the replacement cylinder includes a projection configured to engage the o-ring of the first and second flanges of the pump, and the step of replacing the cylinder of the pump with the replacement cylinder further includes the step of engaging the projections of the first and second end plates with the o-rings of the first and second flanges.

* * * * *

UNITED STATES PATENT AND TRADEMARK OFFICE

CERTIFICATE OF CORRECTION

PATENT NO. : 7,284,961 B2
APPLICATION NO. : 10/162747
DATED : October 23, 2007
INVENTOR(S) : Jerry Jacobsen It is certified that error appears in the above-identified patent and that said Letters Patent is hereby corrected as shown below:

In claim 3, column 12, line 21, "original" should read --original piston--.

Signed and Sealed this

Eleventh Day of March, 2008

JON W. DUDAS
*Director of the United States Patent and Trademark Office*